US010100682B2

(12) United States Patent
Grill et al.

(10) Patent No.: US 10,100,682 B2
(45) Date of Patent: Oct. 16, 2018

(54) LUBRICATION OF EXPANSION MACHINES

(71) Applicant: ORCAN ENERGY AG, München (DE)

(72) Inventors: Andreas Grill, München (DE); Jens-Patrick Springer, München (DE); Gabor Ast, München (DE); Andreas Sichert, Laufen (DE); Richard Aumann, München (DE); Andreas Schuster, Tussenhausen (DE)

(73) Assignee: ORCAN ENERGY AG, München (DE)

( * ) Notice: Subject to any disclaimer, the term of this patent is extended or adjusted under 35 U.S.C. 154(b) by 180 days.

(21) Appl. No.: 14/653,242

(22) PCT Filed: Dec. 3, 2013

(86) PCT No.: PCT/EP2013/075310

§ 371 (c)(1),
(2) Date: Jun. 17, 2015

(87) PCT Pub. No.: WO2014/095333

PCT Pub. Date: Jun. 26, 2014

(65) Prior Publication Data

US 2016/0169055 A1 Jun. 16, 2016

(30) Foreign Application Priority Data

Dec. 21, 2012 (EP) ..... 12198869

(51) Int. Cl.
*F01K 25/06* (2006.01)
*F01M 7/00* (2006.01)
(Continued)

(52) U.S. Cl.
CPC ..... *F01K 25/06* (2013.01); *F01K 17/04* (2013.01); *F01M 1/02* (2013.01); *F01M 7/00* (2013.01);
(Continued)

(58) Field of Classification Search
CPC ..... F01K 25/00–25/14
(Continued)

(56) References Cited

U.S. PATENT DOCUMENTS 3,292,366 A 12/1966 Rice et al.
4,044,561 A * 8/1977 Hohn ..... F01D 25/166 277/432
(Continued)

FOREIGN PATENT DOCUMENTS

CN 101660596 A 3/2010
DE 102007008609 A1 8/2008
(Continued)

OTHER PUBLICATIONS

European Patent Office. International Search Report dated Oct. 14, 2014. International Application No. PCT/EP2013/075310. International Filing Date: Dec. 3, 2013. Name of Applicant: Orcan Energy GMBH. English Language. 3 pages.

*Primary Examiner* — Laert Dounis
(74) *Attorney, Agent, or Firm* — Moore & Van Allen PLLC; Henry B. Ward, III

(57) ABSTRACT

The invention relates to a thermodynamic circuit process device comprising a working medium having a lubricant additive; an expansion machine (5) for converting enthalpy in the working medium into mechanical energy; a multi-stage pressure-increasing apparatus (1) for the step-by-step pressurization of the working medium; a means (4) for branching a part of the working medium between two stages of the multi-stage pressure-increasing apparatus (1); and a means (4) for feeding the branched off part of the working medium to one or a plurality of bearing points of the expansion machine. The invention further relates to a corresponding method for lubricating an expansion machine in a thermodynamic circuit process device.

18 Claims, 1 Drawing Sheet

(51) Int. Cl.

| | |
|---|---|
| ***F01K 17/04*** | (2006.01) |
| ***F22D 11/02*** | (2006.01) |
| ***F01M 1/02*** | (2006.01) |
| *F01K 7/36* | (2006.01) |
| *F22B 1/16* | (2006.01) |

(52) U.S. Cl.
CPC ..... *F22D 11/02* (2013.01); *F01K 7/36* (2013.01); *F01M 2001/023* (2013.01); *F01M 2001/0238* (2013.01); *F22B 1/167* (2013.01)

(58) Field of Classification Search
USPC ..... 60/657, 641.1–683
See application file for complete search history.

(56) References Cited

U.S. PATENT DOCUMENTS

| | | | | |
|---|---|---|---|---|
| 4,191,021 | A | 3/1980 | Nakamura et al. | |
| 4,276,002 | A * | 6/1981 | Anderson | F04D 13/04 415/112 |
| 5,180,034 | A * | 1/1993 | Lopes | F16N 7/40 184/6.1 |
| 5,329,771 | A | 7/1994 | Kytömäki et al. | |
| 2009/0188253 | A1* | 7/2009 | Smith | F01C 1/16 60/657 |
| 2011/0047958 | A1* | 3/2011 | Yamashita | F01D 25/20 60/39.08 |

FOREIGN PATENT DOCUMENTS

| | | | | |
|---|---|---|---|---|
| DE | 202011109838 | | 3/2012 | |
| GB | 2427002 | A | 12/2006 | |
| JP | 54047048 | A * | 4/1979 | F01K 7/00 |

* cited by examiner

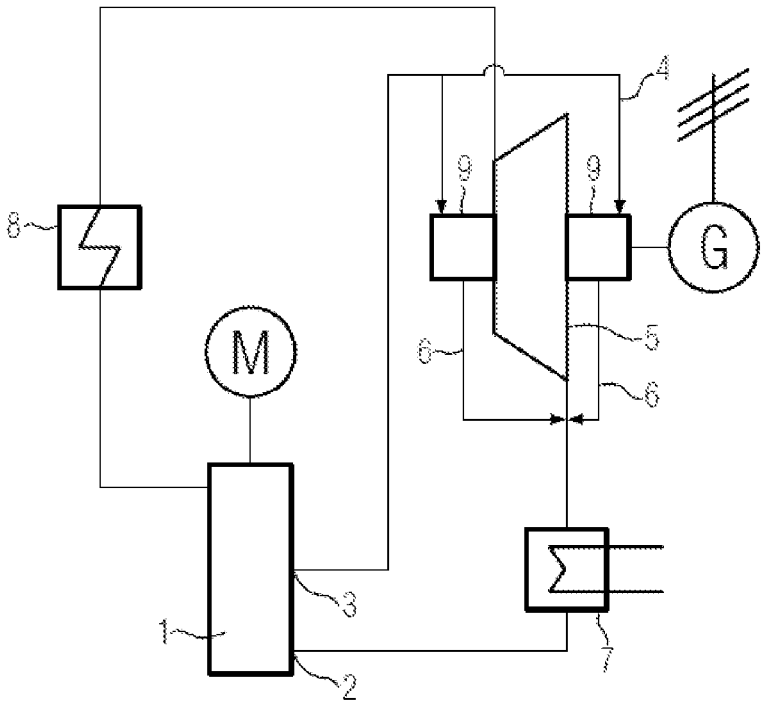
4
9
9
8
G
M
6
5
6
3
1
2
7

LUBRICATION OF EXPANSION MACHINES

FIELD OF THE INVENTION

The present invention relates to a thermodynamic circuit process device comprising a working medium having a lubricant additive and an expansion machine for converting enthalpy in the working medium into mechanical energy.

PRIOR ART

The operation of expansion machines, such as steam turbines, is known in prior art, for example, with the aid of the Organic Rankine Cycle (ORC) method for generating electric energy by employing organic media, for example organic media having low vaporization temperatures which generally have higher vaporization pressures at equal temperatures compared to water as the working medium. ORC plants constitute the realization of the Clausius Rankine cycle where electric energy is obtained, for example, in principle by adiabatic and isobaric changes of the state of a working medium. By vaporization, expansion and subsequent condensation of the working medium, mechanical energy is obtained and converted into electric energy. In principle, the working medium is brought to the operating pressure by a feed pump, and energy in the form of heat provided by combustion or by a flow of waste heat or any other source of heat is supplied to it in a vaporizer. The working medium flows from the vaporizer via a pressure pipe to an expansion machine where it is expanded to a lower pressure. Subsequently, the expanded working medium steam flows through a condenser where heat exchange takes place between the vaporous working medium and a cooling medium, whereupon the condensed-out working medium is pressurized again by the feed pump and returned to the vaporizer in a cyclic process.

A particular class of expansion machines is constituted by volumetrically operating expansion machines, which are also referred to as displacement expansion machines, and comprise one or more working chamber(s) and perform work during a volume increase of this (these) working chamber(s) during the expansion of the working medium. These expansion machines are realized, for example, in the form of piston expansion machines, screw expansion machines, or scroll expanders. Such volumetrically operating expansion machines are in particular employed in ORC systems of small power classes (e. g. with an electrical power of 1 to 500 kW). In contrast to turbines, however, volumetrically operating expansion machines require lubrication by a lubricant in particular of the piston or of the profiles (flanks) of the expansion room that roll on each other, and of the rolling bearings and the sliding walls of the working chamber. So, lubrication of the bearing points and the contacting flanks is required.

From the prior art disclosed in document GB 2427002, a method for lubricating the bearings of the expansion machine is known where a working medium with a lubricant additive is branched off upon pressure increase by the feed pump and supplied to the bearings.

In the expansion machine used according to internal prior art, the lubrication of the high-pressure side and the low-pressure side bearings is effected each by lubricant supply. The lubricant is directed to the bearing points, passes the bearing and exits from the bearing via a connection to the low-pressure side and enters the exhaust steam path. There, the liquid oil mingles with the exhaust steam and is transported to the condenser. Both bearing points are approximately at the same pressure level since the two bearing points are interconnected via a bore/conduit. The pressure level at the bearing points is of the order of the pressure at the outlet of the expansion machine.

The branching off of the lubricant-containing working medium upon the pressure increase to working pressure by the feed pump, however, involves the following disadvantages. For supplying the lubricant/working medium solution, the pressure must be somewhat above the pressure level of the bearing points. Excessive pressure could lead to changed and undesired flow conditions in the bearings. Furthermore, an excessive amount of fluid could flow towards the bearings. For this reason, throttles are employed to limit the pressure level. A pressure increase beyond the required degree with subsequent throttling, however, is energetically disadvantageous. Moreover, a further component (i. e. a throttle) must be installed.

Therefore, there is a demand for providing a method for lubricating expansion machines in which the above mentioned problems are eliminated or at least attenuated. This is the object underlying the present invention.

DESCRIPTION OF THE INVENTION

The above mentioned object is achieved by a thermodynamic circuit process device with a working medium with a lubricant additive; an expansion machine for converting enthalpy in the working medium into mechanical energy; a multi-stage pressure-increasing apparatus (for example a feed pump) for the step-by-step pressurization of the working medium; a means for branching off a part of the working medium between two stages of the multi-stage pressure-increasing apparatus; and a means for feeding the branched off part of the working medium to one or a plurality of bearing points of the expansion machine. The tapping of the multi-stage pressure-increasing apparatus for branching off a part of the working medium is advantageous in that the working medium with the lubricant is directly branched off from the multi-stage pressure-increasing apparatus at a suited pressure level. In this manner, otherwise required means for throttling the pressure before the medium is fed to the bearings may be eliminated. The thermodynamic quantity of the enthalpy of the working medium comprises, as usual, the internal thermal energy and the volume work to be performed ("pressure energy").

According to a further development of the thermodynamic circuit process device, the multi-stage pressure-increasing apparatus may comprise a multi-stage pump, in particular a multi-stage centrifugal pump, or several, directly successive pumps. Here, in case of several pumps, in particular in case of two pumps, these may be based on different functional principles, they may be, for example, designed as reciprocating pump, centrifugal pump, screw pumps, etc. On the other hand, the pressure-increasing stages may also have the same functional principle and are then preferably accommodated in a housing ("a pump").

In a further development of the thermodynamic circuit process device, the means for branching off a part of the working medium may comprise a branch, in particular a bore, between two stages of the multi-stage pump, or a branch between two pumps. This is a simple practical realization of the branching means.

According to another further development of the thermodynamic circuit process device, the means for feeding the branched off part of the working medium to one or several bearing points of the expansion machine may comprise one or several pipelines.

According to a further development of the thermodynamic circuit process device, in case of a multi-stage pump with two or more impellers, the means for branching off a part of the working medium may be disposed in the conveying direction of the pump between two directly adjacent impellers. In this further development, the step-by-step pressure increase of the working medium may be utilized by means of the impellers, and a part of the working medium (mixture of a working agent and the lubricant) may be branched off at a suited point.

According to another further development of the thermodynamic circuit process device, it may furthermore comprise means for discharging the working medium with the lubricant additive from the bearing point or points, where the means for discharging the working medium may in particular be in fluid communication with an outlet of the expansion machine. This has the advantage that the working medium including the lubricant may be discharged and returned to the circuit process.

The circuit process device may be an Organic Rankine Cycle device, and/or the expansion machine may be selected from the group consisting of a piston expansion machine, a screw expansion machine, a scroll expander, a vane machine, and a roots expander.

According to another further development of the thermodynamic circuit process device, the working medium may be provided in the form of an organic working medium, where the working medium may in particular comprise or consist of a fluorinated working medium, for example fluorinated hydrocarbons, fluorinated carbons, fluoroether or fluoroketones, and/or the lubricant may in particular comprise or consist of a refrigerant oil, and/or wherein the lubricant proportion of the working medium may be between 0.1 and 10 weight percent.

The thermodynamic circuit process device according to the invention or one of its further developments may be part of a steam power station.

The above mentioned object is furthermore achieved by a method for lubricating an expansion machine in a thermodynamic circuit process device, wherein the circuit process device comprises said expansion machine, a multi-stage pressure-increasing apparatus and a working medium with a lubricant additive, and wherein the method comprises the steps of: step-by-step pressurizing the working medium with the multi-stage pressure-increasing apparatus; branching off a part of the working medium between two stages of the multi-stage pressure-increasing apparatus; and feeding the branched off part of the working medium to at least one or a plurality of bearing points of the expansion machine for lubricating the bearing points. The advantages correspond to those that were mentioned in connection with the device according to the invention.

Moreover, the further developments of the method according to the invention and their advantages correspond to those mentioned in connection with the device according to the invention.

Further features and exemplary embodiments as well as advantages of the present invention will be illustrated more in detail hereinafter with reference to the drawings. It will be understood that the embodiments do not exhaust the field of the present invention. It will be furthermore understood that some or all features described below may also be combined with each other in a different way.

DRAWINGS

FIG. 1 by way of example illustrates a lubrication system for an expansion machine according to the present invention.

EMBODIMENTS

In accordance with the invention, the working medium will be directly branched off from the multi-stage feed pump at a suited pressure level. The solution according to the invention advantageously combines the function of a condensate pump and of the feed pump in one housing and permits the withdrawal of liquid at a suited point, this point (number of already passed stages) determining the pressure level of the withdrawn liquid. If multi-stage feed pumps are employed, a particular property of these pumps may be utilized. The pressure increase in the multi-stage pumps is effected by stringing together several impellers, so that a pressure increase of e. g. 1 bar occurs per stage. The impellers are installed into a housing on a shaft and have equal diameters. In the direction of the shaft, a stepwise pressure increase can be observed. By tapping at a suited point, liquid, in the present case a lubricant/working medium solution, may now be withdrawn at the pressure level that is already the appropriate pressure level. Thus, no further pressure increase of this fluid must be accomplished.

FIG. 1 shows a schematic diagram of a thermodynamic circuit process device according to the present invention.

As is shown in FIG. 1, the thermodynamic circuit process device comprises, according to one example of the present invention, a multi-stage feed pump 1 with several impellers. The multi-stage feed pump 1 is supplied with a liquid working medium/lubricant solution, this solution entering the pump at the inlet 2. The flow stream required for the lubrication of the bearing points 9 of the expansion machine 5 is directly branched off at a suited point 3 between two adjacent impellers at a pressure level prevailing there and provided to the bearing points 9. The bearing points 9 are supplied via the lubricant supply 4, the lubricant passing the bearing points and being discharged via a discharge conduit/device 6. The discharge conduit/device 6 is in communication with the outlet of the expansion machine 5 which in turn is in communication with the condenser 7.

It should be noted that both the lubricant supply 4 and the lubricant discharge conduit 6 may be integrated in the expansion machines 5 and do not have to be designed as separate conduits but may be part of the housing or the rotors. The exhaust steam and the lubricant reach the condenser 7 from which the liquefied working medium/lubricant solution is directed to the bearing points 9 and to the evaporator 8 by means of the feed pump as described. In the evaporator 8, the working medium will evaporate while the lubricant remains liquid and serves to lubricate and seal the flanks of the expansion machine 5.

The invention claimed is:

1. A thermodynamic circuit process device, comprising:

a working medium with a lubricant additive;

an expansion machine for converting enthalpy in the working medium with the lubricant additive into mechanical energy;

a multi-stage pressure-increasing pump for a step-by-step pressurization of the working medium with the lubricant additive;

a means for branching off a part of the working medium with the lubricant additive between two stages of the multi-stage pressure-increasing pump at a suited pressure level; and a means for feeding the branched off part of the working medium with the lubricant additive at the suited pressure level to one or more bearing points of the expansion machine, wherein the one or more bearing points receive the working medium with the lubricant additive at the suited pressure level.

2. The thermodynamic circuit process device according to claim 1, wherein said multi-stage pump is a multi-stage centrifugal pump.

3. The thermodynamic circuit process device according to claim 2, wherein said means for branching off a part of the working medium with the lubricant additive comprises a bore between two stages of the multi-stage pump.

4. The thermodynamic circuit process device according to claim 1, wherein said means for feeding the branched off part of the working medium with the lubricant additive at the suited pressure level to one or a plurality of bearing points of the expansion machine comprises one or a plurality of pipelines.

5. The thermodynamic circuit process device according to claim 2, wherein the multi-stage pump includes a plurality of impellers, and said means for branching off a part of the working medium with the lubricant additive at the suited pressure level is disposed in a conveying direction of the multi-stage pump between two directly adjacent impellers.

6. The thermodynamic circuit process device according to claim 1, furthermore comprising:

a means for discharging said working medium with said lubricant additive from said bearing point or points, wherein said means for discharging the working medium is in fluid communication with an outlet of the expansion machine.

7. The thermodynamic circuit process device according to claim 1, in which the thermodynamic circuit process device is an Organic Rankine Cycle device, and/or in which the expansion machine is selected from the group consisting of a piston expansion machine, a screw expansion machine, a scroll expander, a vane machine, and a roots expander.

8. The thermodynamic circuit process device according to claim 1, wherein said working medium is provided in a form of an organic working medium, said working medium comprising a fluorinated working medium, and/or said lubricant comprising a refrigerant oil, wherein a lubricant proportion of said working medium is between 0.1 and 10 weight percent.

9. A steam power station, comprising the device according to claim 1.

10. A method for lubricating an expansion machine in a thermodynamic circuit process device, wherein said thermodynamic circuit process device comprises an expansion machine, a multi-stage pressure-increasing pump and a working medium with a lubricant additive, and wherein said method comprises the steps of:

step-by-step pressurizing the working medium with the lubricant additive with the multi-stage pressure-increasing pump;

branching off a part of said working medium with the lubricant additive between two stages of the multi-stage pressure-increasing pump at a suited pressure level; and feeding the branched off part of the working medium with the lubricant additive at the suited pressure level to one or more bearing points of the expansion machine for lubricating the one or more bearing points, wherein the one or more bearing points receive the working medium with the lubricant additive at the suited pressure level.

11. The method according to claim 10, wherein the branching off of a part of the working medium with the lubricant additive via a bore is effected between the two stages of the multi-stage pump.

12. The method according to claim 10, wherein the feeding of the branched off part of the working medium with the lubricant additive at the suited pressure level to one or more bearing points of the expansion machine is effected via one or a plurality of pipelines.

13. The method according to claim 10, wherein the multi-stage pump includes a plurality of impellers, and the branching off of a part of the working medium with the lubricant additive at the suited pressure level is effected in a conveying direction of the multi-stage pump between two directly adjacent impellers.

14. The method according to claim 10, further comprising the step of:

discharging said working medium with said lubricant additive from the one or more bearing points, wherein the discharging of said working medium is effected in fluid communication with an outlet of the expansion machine.

15. The method according to claim 10, wherein said working medium comprises a fluorinated working medium, and/or said lubricant comprises refrigerant oil, wherein a lubricant proportion of said working medium is between 0.1 and 10 weight percent.

16. The method according to claim 10, wherein the multi-stage pump is a multi-stage centrifugal pump.

17. The thermodynamic circuit process device according to claim 1, wherein the expansion machine is selected from a group consisting of a piston expansion machine, a scroll expander, a vane machine and a roots expander.

18. The thermodynamic circuit process device according to claim 17, further comprising a means for discharging said working medium with said lubricant additive from said one or more bearing points, wherein said means for discharging the working medium is in fluid communication with an outlet of the expansion machine.

* * * * *